US006437815B1

(12) United States Patent
Burkart

(10) Patent No.: US 6,437,815 B1
(45) Date of Patent: Aug. 20, 2002

(54) TACHOGRAPH HAVING A SHALLOW, INSTALLABLE HOUSING

(75) Inventor: Harald Burkart, Villingen-Schwenningen (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/718,564

(22) Filed: Nov. 22, 2000

(30) Foreign Application Priority Data

Nov. 27, 1999 (DE) ..... 299 20 902 U

(51) Int. Cl.[7] ..... B41J 29/00; B41J 29/02; G07C 5/00; G07C 5/08; G07C 7/00

(52) U.S. Cl. ..... 347/222

(58) Field of Search ..... 346/14, 17, 18, 346/25, 33 D; 347/222; 73/488, 489, 490, 35; 701/35

(56) References Cited

FOREIGN PATENT DOCUMENTS

| | | |
|---|---|---|
| DE | 29920901 | * 1/2000 |
| JP | 11-283064 | * 10/1999 |
| JP | 2000-48233 | * 2/2000 |

* cited by examiner

*Primary Examiner*—Huan Tran
(74) *Attorney, Agent, or Firm*—Sidley Austin Brown & Wood, LLP

(57) ABSTRACT

In a printing apparatus (18) used in the tachograph (3), there is a firm association between the thermal print head (53) and the transport roller (47), with an outlet opening (26) of an output channel (58) being situated in the region of the closure gap of a carriage (19) in the printing apparatus (18), the recording material (48) running in a relatively straight line between an insertion channel (70) and the outlet opening (26), and a cover (57) being provided which permits access to the thermal print head (53) and to the transport roller (47) and forms a delimiting wall of the output channel (48).

9 Claims, 3 Drawing Sheets

1
67
63
2
57
46
47
35
31
40/43
28
32
19
66
48
26
58
59
27
60
70
61
29
20
53
54
P
55
38
17
56
30
33
44
49
50
25
34
36
39/42
52
51
64
62
18
65

68
67
57
69

TACHOGRAPH HAVING A SHALLOW, INSTALLABLE HOUSING

The innovation relates to a tachograph having a shallow, installable housing, having a display apparatus and having provision for inserting and removing driver's data cards from the front side, having buttons for operational control and for retrieving memory contents in the tachograph and having a printing apparatus which records on tape-like recording material, comprises a thermal print head, a transport roller which is actively connected, with a force fit, to the thermal print head, with the recording material located in between, and is driven by a drive, and a holder which stores a roll of tape forming the stock of recording material, and which can be moved out from the front side of the housing of the tachograph in order to reload a roll of tape.

In the case of such a unit design, there is just a narrow side of the housing, forming the front side of the tachograph, available for looking at the display apparatus, for accessing the read and write units associated with the driver data cards, for operating the buttons and for handling the printing apparatus. In addition, a clearly readable display (and hence one which is as large as possible) and also buttons whose operation is unambiguous and possibly does not require them to be looked at directly are necessary at a tachograph's installation location, which is not always adequately illuminated, in other words at the workplace of a bus driver or lorry driver. Furthermore, it is expedient to associate sufficiently large recesses, serving as an aid to insertion, with the read/write units' insertion/output openings, so that the front face of the printing apparatus, which can be moved out from the front side of the tachograph, has only a relatively limited surface area available on which sufficiently easy-to-handle means for operating the printing apparatus, possibly closure means as well, an outlet opening for the printed recording material, and also buttons have to be arranged. This means that, when the front face of the tachograph has been provided with the aforementioned operating elements and inlet openings, the remaining scope for designing the front side of the tachograph, particularly the front side of the printing apparatus, is severely limited.

The object of the present innovation was therefore to improve the design options on the front side of a tachograph of this generic type without impairing any operations of the tachograph.

Claim 1 describes how the object is achieved. Further advantageous refinements to the innovation can be found in the dependent claims.

The crucial advantage of the innovation can be seen, in particular, in that the front face of the printing apparatus can be designed without regard for the outlet opening. This means that, by way of example, there is a relatively large degree of freedom for the arrangement and design of handle elements, specifically of relatively large handle elements, that handle elements can be arranged so that they can be recessed/swung out, and/or locking means can be provided.

A further fundamental advantage can be seen in that the closure gap, which is present anyway, between the printing apparatus or the printing mechanism housing and the front wall of the tachograph is jointly used for outputting printed recording material, and hence also the risk of soiling is reduced by comparison with an outlet opening usually provided in addition to the closure gap.

The innovation also has the advantage that the physical height of the printing apparatus is determined solely by the diameter of the roll of tape, and hence the physical height can be reduced to this diameter. Apart from simplifying production of the printing mechanism housing by using injection molding technology, it is also advantageous that the cover, by forming a wall of the output channel, permits direct access to the output channel and makes it possible to clear a paper jam in the outlet region of the printing apparatus. For the rest, despite the outlet opening's position provided in accordance with the innovation, the measure of feeding the recording material to the printing mechanism on the opposite side from the front face of the printing mechanism housing affords the possibility of guiding the recording material so that it is largely stretched, and hence of improved transport conditions inside the printing mechanism housing, which prevent jamming.

In the context of the printing apparatus being designed such that the printing mechanism housing is articulated on the carriage and the inlet opening is situated on the other side of the end wall of the printing mechanism housing, handling when threading the recording material into the printing mechanism is trouble-free in a great number of installation positions for the tachograph. When doing this, it is possible to look at the inlet opening and the outlet opening at the same time.

An illustrative embodiment of the innovation is explained below with the aid of drawings, in which.

Figure 1:
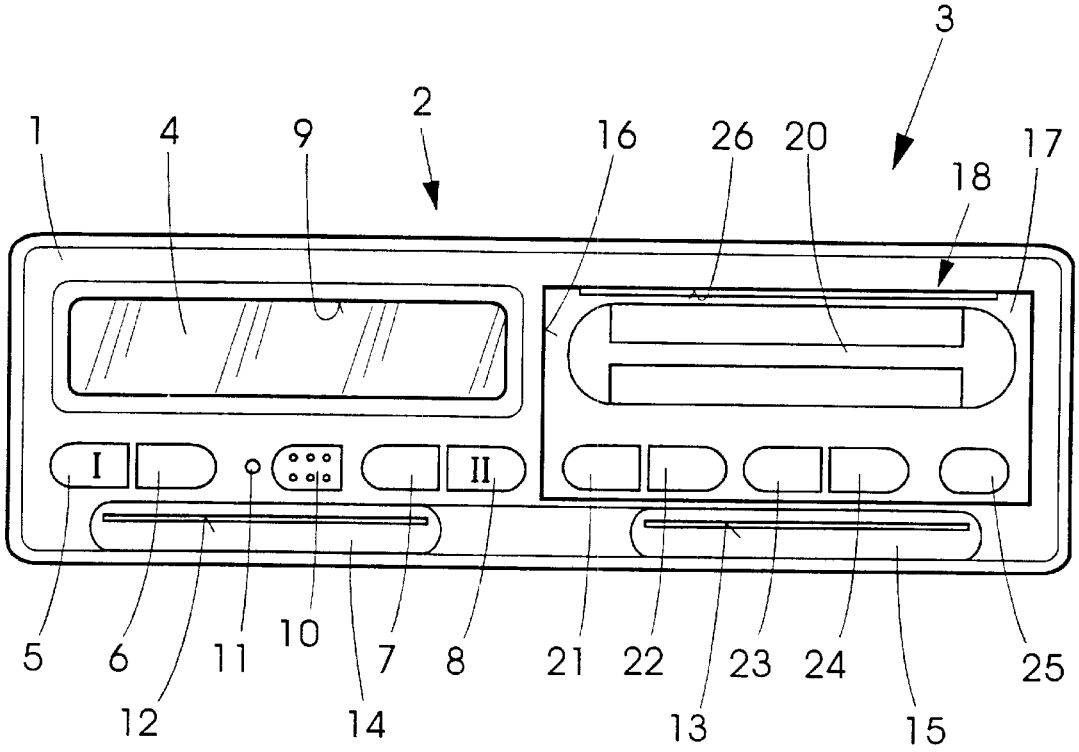
FIG. 1 shows a front view of a tachograph of this generic type.

In FIG. 1, 1 denotes a panel or a front wall closing off a housing 2 (FIG. 3) of a tachograph 3 of rectangular cross section at its front side. The front wall holds a display apparatus 4 and also buttons 5, 6 and 7, 8. In this context, the buttons 5 (I) and 8 (II) are used for signing on the driver and co-driver, and the buttons 6 and 7 are used to release the respective data cards. 9 denotes a window section associated with the display apparatus 4. A spring-mounted closure element 10 covers a plug socket; 11 represents a warning lamp. Slots 12 and 13 are used for inserting data cards associated with the drivers into read and write units in the tachograph 3, the slots 12, 13 being formed in the bottom of in each case funnel-like recesses 14 and 15. In addition, the front wall 1 contains a cutout 16 which is covered by a front element 17 of a printing -apparatus 18 (FIG. 2), specifically such that the front element 17 blends in with the front face of the front wall 1 of the tachograph 3 to aesthetic effect, particularly such that the faces are flush. The printing apparatus 18 comprises a carriage 19 which can be used to move it out of the tachograph 3. The carriage 19 can have an associated bistable dwell mechanism which, when recording material needs to be replenished, can be unlocked and locked by operating the front element 17, which thus serves as a button. In addition, the front element 17, which is provided with a handle bar 20, contains a plurality of buttons 21, 22 and 23, 24, and also 25. These are used together with the buttons 5 and 8 to select the most important working time data for the driver and co-driver, to skip forward and backward in the respective data records for a selected data type and to initiate printing.

FIG. 1 also shows an essential feature of the innovation, namely the fact that a section of the closure gap existing between the cutout 16 in the front wall 1 and the front element 17 is in the form of an outlet opening 26 for the printed recording material or is used as a slot-like outlet opening without any additional configuration.

Figure 2:
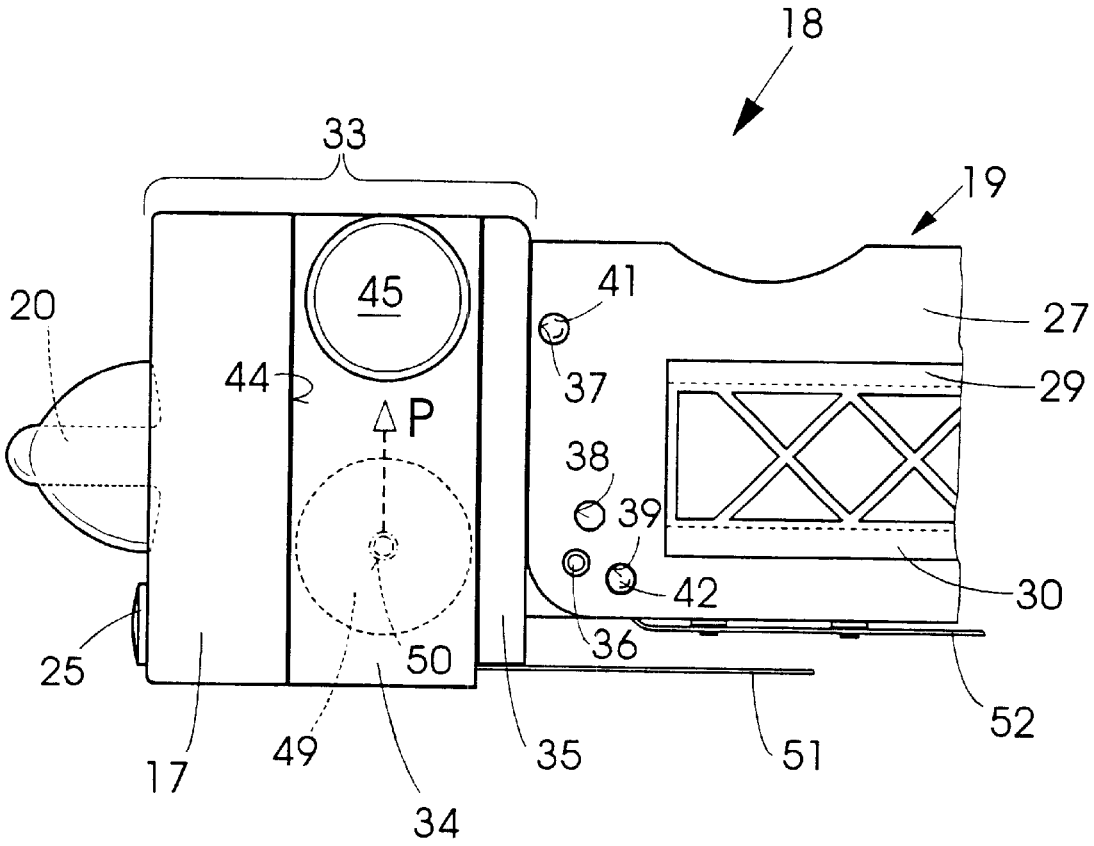
FIG. 2 shows a partial side view of a printing apparatus for a tachograph as shown in FIG. 1.
Figure 3:
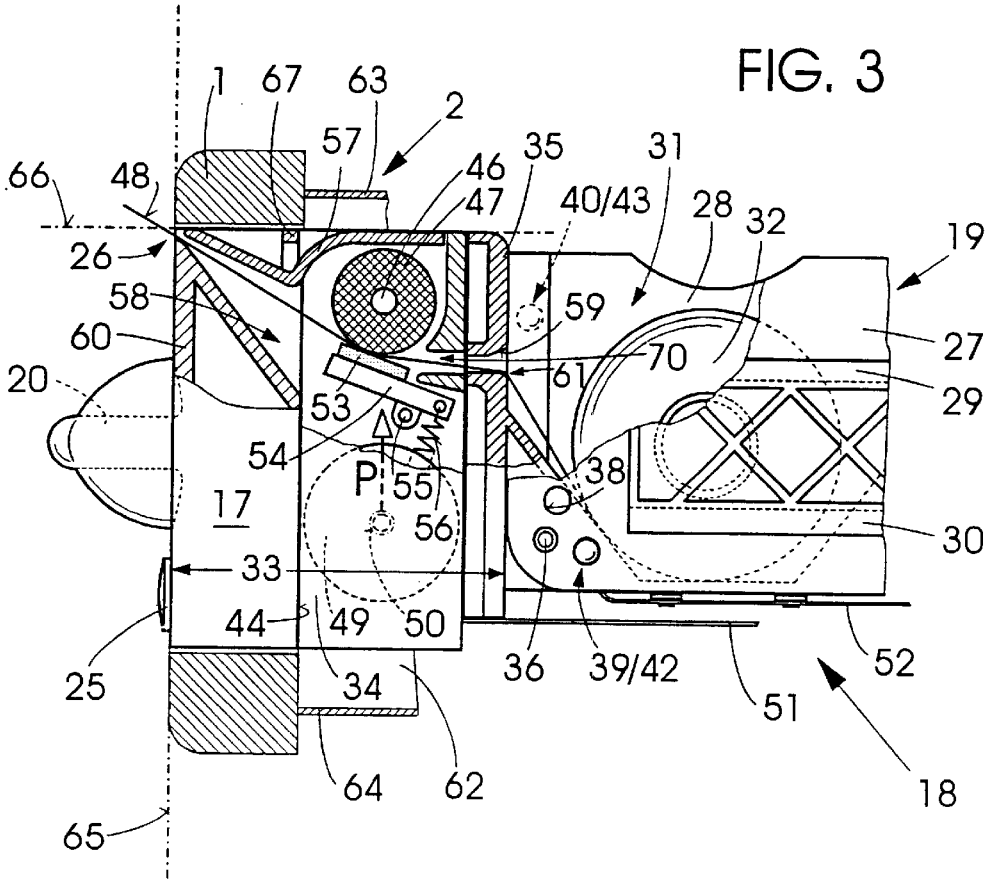
FIG. 3 shows an illustration as shown in FIG. 2 with partial sections and a schematic association of the housing of the tachograph.

The side views, FIGS. 2 and 3, of the printing apparatus 18 show that guide rails are formed on side walls 27 and 28 of the carriage 19, specifically such that they stiffen the side walls 27, 28. The guide rails associated with the side wall 27 are denoted by 29 and 30. Formed between the side walls 27, 28 and a baseplate (not shown in detail), which connects them, of the carriage 19 is a preferably trough-like holder 31 for a roll of tape 32 of the recording material.

In the illustrative embodiment shown, the actual printing mechanism housing 33 is formed by joining together the front element 17, a bearing body 34 and a flange plate 35. The latter mounts the printing mechanism housing 33 so that it can pivot with respect to the side walls 27, 28 of the carriage 19, to which end either a continuous spindle or two aligned spindle bolts—one is denoted by 36—are provided. To prevent rotation and to limit the pivot angle of the printing mechanism housing 33, there are latching means in the form of studs 41, 42, 43 which are integrally formed on cheeks (not shown in more detail) formed on the flange plate 35 and interact with holes 37, 38, 39, 40 in the side walls 27, 28. As FIG. 2 also shows, a niche 44 is provided on the printing mechanism housing 33 in the region of the bearing body 34. The niche is used for the recessed arrangement of a knurled wheel 45 which is associated with the shaft 46 of a transport roller 47 in the printing apparatus 18 so that the recording material 48 can be transported by hand in the event of a paper jam, for example. 49 is a schematic 1illustration of a motor driving the transport roller 47. An arrow P setting out from the motor shaft or from a pinion 50 which is mounted in the usual manner on the motor shaft is intended to symbolize a train of wheels provided between the motor 49 and the transport roller 47. A ribbon cable denoted by 51 is used to supply power to the motor 49 and for electrical connection to a printed circuit board (not shown) which is associated with the buttons 21, 22, 23, 24 and 25 and is arranged in the front element 17. A further ribbon cable 52 is provided to supply power to a thermal print head 53 and is attached to the carriage 19 in a suitable manner (not denoted in more detail). A support 54 which is associated with the thermal print head 53 and additionally performs the function of a heat sink is mounted so that it can pivot about a spindle 55 and is subject to the action of at least one spring 56.

FIG. 3 additionally shows that the printing mechanism housing 33 has an associated cover 57 which, when removed, allows access to an output channel 58 for the transport roller 47 and to the print head unit 53/54. 59 denotes an inlet opening associated with the recording material 48. This inlet opening represents the opening to an insertion channel 70 leading to the printing gap between the thermal print head 53 and the transport roller 47 and is formed on the other side of the end wall 60 of the printing mechanism housing 33 in the innovative embodiment of the printing apparatus 18. The result of this is relatively stretched guidance of the recording material 48 with just one diversion, serving for orientation, at a suitably rounded edge 61 of the inlet opening 59.

Figure 4:
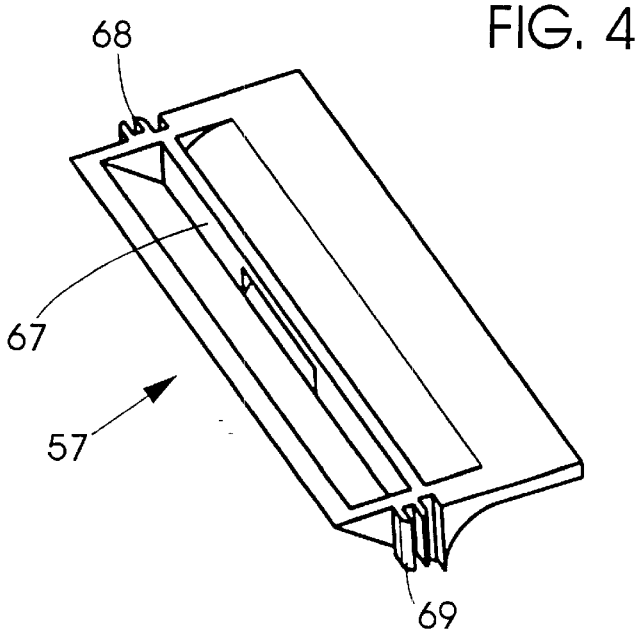
FIG. 4 shows a perspective illustration of the cover of the printing mechanism housing.

For the sake of completeness, it should be mentioned in connection with FIG. 3 that the reference numerals 62, 63 and 64 denote components connected to the front wall 1, that is to say a lid part and a base part of the housing 2 of the tachograph 3. In addition, the concept underlying the innovation should be emphasized again, namely that the outlet opening 26 is situated in the region of the intersection between a front plane 65 of the end wall 60 and a delimiting plane 66 situated at right angles to the latter, and hence a section of the closure gap between the front wall 1 and the front element 17 is used, at least jointly used, as an outlet opening 26, and, by way of example, that edge of the end wall 60 which delimits the outlet opening can be in the form of a relatively sharp edge, that is to say in the form of a tear-off edge. FIG. 4 shows that the cover 57 has a relieved web 67 as handle means. In addition, spring elements 68, 69 are integrally formed on the cover 57 and serve to mount the cover 57 in the printing mechanism housing 33. [lacuna] may naturally also be of two-part design, with a housing part being articulated directly on the carriage 19. In addition, if a removable cover is not going to be dispensed with, it is conceivable to provide it merely in the region of the transport roller 47. This allows the outlet opening 26 of the output channel to be formed set back from the front plane 65 of the end wall 60, so that the printed recording material does not emerge directly at the intersection between the planes 65 and 66, as in the case of the illustrative embodiment described, but close thereto instead, that is to say it first enters the closure gap and is guided a short distance therein before reaching the tear-off edge situated in the front plane 65.

What is claimed is:

1. Tachograph having a shallow, installable housing, having a display apparatus and having provision for inserting and removing driver's data cards from the front side, having buttons for operational control and for retrieving memory contents in the tachograph and having a printing apparatus which records on tape-like recording material, comprises a thermal print head, a transport roller which is actively connected, with a force fit, to the thermal print head, with the recording material located in between, and is driven by a drive, and a holder which stores a roll of tape forming the stock of recording material, and which can be moved out from the front side of the housing of the tachograph in order to reload a roll of tape, characterized in that at least the thermal print head (53), the transport roller (47) and the drive (49, 50, P) driving said transport roller are arranged in a cuboid printing mechanism housing (33) whose front face is essentially flush with the front face of a front wall (1) of the tachograph (3) when the printing apparatus (18) is in the operating position, in that the printing mechanism housing (33) contains an insertion channel (70) used for feeding the recording material (48) to the printing gap between the thermal print head (53) and the transport roller (47) and an output channel (58) used for guiding the printed recording material (48) away from the printing gap, the output channel (58) being designed such that the slot-like outlet opening (26) of the output channel (58) is situated in the region of the intersection between a front plane (65) of an end wall (60) of the printing mechanism housing (33) and a delimiting plane (66), which is essentially at right angles to the end wall (60), of the printing mechanism housing (33).

2. Tachograph according to claim 1, characterized in that the inlet opening (59) of the insertion channel (70) is provided on the other side of the end wall (60) of the printing mechanism housing (33), in that the holder (31) for the roll of tape (32) is designed to be on a carriage (19) which is mounted so as to be displaceable in the housing (2) of the tachograph (3), and in that the printing mechanism housing (33) is mounted on the carriage (19) so that it can pivot about a spindle (36) which is parallel to the axis of the roll of tape (32).

3. Tachograph according to claim 1, characterized in that a cover (57) which can be detachably connected to the printing mechanism housing (33) is provided such that an inwardly pointing face of the cover (57) forms a delimiting face of the output channel (58).

4. Tachograph according to claim 3, characterized in that handle means (web 67) are formed on the cover (57).

5. Tachograph according to claim 1, characterized in that the printing mechanism housing (33) and the holder (31) for the roll of tape (32) are firmly associated with one another and are mounted in the form of a folding shutter in the housing (2) of the tachograph (3) so that they can pivot transversely with respect to the latter's vertical axis.

6. Tachograph according to claim 1, characterized in that the printing mechanism housing (33) and the holder (31) for the roll of tape (32) are firmly associated with one another and are mounted in the form of a folding shutter in the housing (2) of the tachograph (3) so that they can rotate parallel to the latter's vertical axis.

7. Tachograph according to claim 1, characterized in that the output channel (58) opens into the closure gap between the printing mechanism housing (33) and the front wall (1) of the tachograph (3) when the printing apparatus (18) is in the operating position, and the closure gap is in the form of an outlet opening (26) for the printed recording material (48).

8. Tachograph according to claim 1, characterized in that the intersection between the front plane (65) of the end wall (60) of the printing mechanism housing (33) and a delimiting face of the output channel (58) is in the form of a tear-off edge.

9. Tachograph according to claim 1, characterized in that the printing mechanism housing (33) is assembled from at least two components, a bearing body (34), which holds the thermal print head (53), the transport roller (47) and the drive (49, 50, P), and a front element (17), which is provided with the output channel (58) and bears operating means (20).

* * * * *